US011414934B2

(12) United States Patent
Bunney

(10) Patent No.: US 11,414,934 B2
(45) Date of Patent: Aug. 16, 2022

(54) HARMONIC AND VIBRATION DAMPING TUBING MEMBER FOR CONVEYING FLUIDS

(71) Applicant: Larry Raymond Bunney, Edmonton (CA)

(72) Inventor: Larry Raymond Bunney, Edmonton (CA)

(73) Assignees: Larry Raymond Bunney, Alberta (CA); Kevin Kelm, Alberta (CA)

( * ) Notice: Subject to any disclaimer, the term of this patent is extended or adjusted under 35 U.S.C. 154(b) by 0 days.

(21) Appl. No.: 17/164,092

(22) Filed: Feb. 1, 2021

(65) Prior Publication Data

US 2021/0238931 A1 Aug. 5, 2021

Related U.S. Application Data

(60) Provisional application No. 62/969,750, filed on Feb. 4, 2020.

(51) Int. Cl.
*E21B 17/07* (2006.01)

(52) U.S. Cl.
CPC ..... *E21B 17/07* (2013.01)

(58) Field of Classification Search
CPC ..... E21B 17/07
See application file for complete search history.

(56) References Cited

U.S. PATENT DOCUMENTS

| | | | | |
|---|---|---|---|---|
| 4,552,230 | A * | 11/1985 | Anderson | E21B 17/07 175/321 |
| 10,480,260 | B2 * | 11/2019 | Brown | E21B 17/07 |
| 10,982,492 | B1 * | 4/2021 | Gopalan | E21B 17/07 |
| 2012/0247832 | A1 * | 10/2012 | Cramer | E21B 7/24 267/140.13 |
| 2017/0328142 | A1 * | 11/2017 | Pratt | E21B 47/017 |
| 2019/0284883 | A1 * | 9/2019 | Banks | E21B 17/1078 |
| 2021/0087890 | A1 * | 3/2021 | Dinica | E21B 17/07 |
| 2021/0156205 | A1 * | 5/2021 | Pratt | E21B 17/07 |

* cited by examiner

*Primary Examiner* — Taras P Bemko
(74) *Attorney, Agent, or Firm* — Ryan W. Dupuis; Kyle R. Satterthwaite; Ade & Company Inc.

(57) ABSTRACT

A tubing assembly is mounted in series between two piping sections for conveying fluid between the piping sections while isolating vibrations between the two piping sections. The tubing assembly includes an inner tubing member formed of resilient material which is mechanically joined to mounting collars at opposing ends thereof for connection to the adjacent piping sections. Rigid connecting portions are supported on each of the mounting collars at the opposing ends of the assembly which define load bearing surfaces which cooperate with load bearing surfaces of the other connecting portions with vibration damping material undergoing compression between different load bearing surfaces depending upon the direction load is applied across the tubing assembly.

19 Claims, 6 Drawing Sheets

HARMONIC AND VIBRATION DAMPING TUBING MEMBER FOR CONVEYING FLUIDS

This application claims the benefit under 35 U.S.C. 119(e) of U.S. provisional application Ser. No. 62/969,750, filed Feb. 4, 2020.

FIELD OF THE INVENTION

The present invention relates to a tubing assembly for connection in series between two piping sections so as to convey fluid between the two piping sections while isolating transmission of vibrations and harmonics between the two piping sections, and more particularly the present invention relates to a harmonics and vibration damping tubing assembly which remains capable of containing pressure and supporting axial and rotational loads between opposing ends of the tubing assembly while isolating transmission of vibrations and harmonics therethrough.

BACKGROUND

In the production of hydrocarbons from a wellbore, it is common to make use of a downhole pumps supported at the bottom end of a tubing string used to convey produce fluids upwardly to a wellhead of the wellbore. Operation of the pump can produce vibrations which are transmitted up the tubing string and may cause premature wear of various components. In other applications such as drilling a wellbore using a drill string which carries drilling fluid therethrough, the tubing sections of the drill string may also transmit vibrations therethrough which cause premature wear of various components. Although it is desirable to isolate transmission of vibrations through the tubing string, the tubing string in wellbore applications undergoes considerable axial load due to the suspended weight of the tubing string, while also being exposed to high-temperature and high-pressure fluids conveyed through the tubing string. Accordingly, use of simple resilient connections between adjacent piping sections can cause failure by rupturing of the resilient material exposed to the high-pressure and axial loads.

Many industrial applications independent of hydrocarbon wellbores also require use of tubing members which are capable of carrying loads in the axial and circumferential directions while still limiting the transmission of vibrations along the tubing.

SUMMARY OF THE INVENTION

According to one aspect of the invention there is provided a tubing assembly for conveying a fluid between two piping sections while isolating harmonics and vibrations between the two piping sections, the tubing assembly comprising:

first and second mounting collars supported at opposing ends of the tubing assembly and being formed of rigid material, the first and second mounting collars being arranged for rigid mechanical coupling to the two piping sections respectively, each of the mounting collars defining respective boundary portions of a fluid passage extending longitudinally through the tubing assembly for conveying the fluid between the two piping sections;

a tubing member formed of resilient material, the tubing member being connected between the first and second mounting collars, and the tubing member having an inner surface defining a respective boundary portion of the fluid passage of the tubing assembly;

a plurality of first connecting portions formed of rigid material connected to the first mounting collar and defining a plurality of first load bearing surfaces;

a plurality of second connecting portions formed of rigid material connected to the second mounting collar and defining a plurality of second load bearing surfaces;

a vibration damping material connected between the first and second connecting portions;

the rigid material of the first connecting portions being supported in spaced relation with the rigid material of the second connecting portions by the vibration damping material;

wherein at least a portion of the vibration damping material being under compression in a circumferential direction of the tubing assembly against the first load bearing surfaces of the first connecting portions and at least a portion of the vibration damping material being under compression in a circumferential direction of the tubing assembly against the second load bearing surfaces of the second connecting portions when a torque is applied between the first and second mounting collars; and wherein at least a portion of the vibration damping material being under compression in a longitudinal direction of the tubing assembly against the first load bearing surfaces of the first connecting portions and at least a portion of the vibration damping material being under compression in a longitudinal direction of the tubing assembly against the second load bearing surfaces of the second connecting portions when a longitudinal force is applied between the first and second mounting collars.

The tubing assembly is particularly suited for use with downhole pumps suspended in a wellbore by a tubing string for isolating the harmonics and vibration that may be a torsional, axial or lateral force propagated up the tubing string within the wellbore assembly. Tubulars and drive mechanisms within the tubulars, may convey fluid forces or mechanical forces along the tubing string within a wellbore as a result of the actions of the drive mechanism within the tubulars. The tubing assembly described herein can reduce and/or remove a harmonic frequency and resulting vibration, and/or the vibrations created by the mechanisms in a wellbore where these factors are creating adverse wear and/or degradation on the tubulars and drive mechanisms within the well bore.

The tubing assembly may include vibration damping material in the form of a flexible molded coating that is injected into the apparatus to form the isolation barrier which breaks the harmonics caused by the vibration of the drive mechanism in the tubulars to surface from the bottom hole assembly or from the passing of high-pressure fluids within the wellbore tubulars.

The interlocking connection portions enable the drive to withstand the torsional load placed on the tubulars during assembly of the well bore equipment and the torsional load created by the apparatus placed in the wellbore. The flexible material is injected between the splines or connecting portions to break the harmonics in the tubulars used to convey fluids of the wellbore The flexible tubular defines both a portion of the fluid conveyance path while also allowing the drive mechanism to be placed within the thru bore of the flexible tubular. This pressure containing flexible tubular creates the barrier which breaks the harmonics caused by the vibrations of any assembly that may be placed in the wellbore.

Although the tubing assembly is used in a wellbore tubing string according to the illustrated embodiment, the tubing assembly is not limited to wellbore applications. There are many industrial applications where it is desirable to break the harmonics and vibration caused by fluid conveyance in tubulars within an industrial setting such as process facilities.

In preferred embodiments, the first load bearing surfaces include some surfaces that are oriented transversely to the longitudinal direction and that face towards the first mounting collar and the second load bearing surfaces include some surfaces that are oriented transversely to the longitudinal direction and that face towards the second mounting collar, in which said surfaces receive some of the vibration damping material under axial compression against the surfaces.

Also in preferred embodiments, the first load bearing surfaces include some surfaces that are oriented transversely to the longitudinal direction and that face towards the second mounting collar, and the second load bearing surfaces include some surfaces that are oriented transversely to the longitudinal direction and that face towards the first mounting collar, in which said surfaces receive some of the vibration damping material under axial compression against the surfaces.

The tubing assembly may further include at least one intermediate member formed of rigid material and which is supported by the vibration damping material at an intermediate location in the longitudinal direction between the first load bearing surfaces of the first connecting portions and the second load bearing surfaces of the second connecting portions, whereby some of the vibration damping material is in compression in the longitudinal direction between the first loading bearing surfaces and the intermediate member, and whereby some of the vibration damping material is in compression in the longitudinal direction between the intermediate member and the second loading bearing surfaces.

In the illustrated embodiment, the first connecting portions comprise elongate fingers extending in the longitudinal direction from the first mounting collar towards the second mounting collar, and the second connecting portions comprise elongate fingers extending in the longitudinal direction from the second mounting collar towards the first mounting collar in overlapping relationship with the first connecting portions in the longitudinal direction. Preferably each of the first connecting portions is spaced in the circumferential direction from each of the second connecting portions. Preferably the fingers defining the first connecting portions are integrally and seamlessly formed of unitary material together with a first collar portion which is mechanically coupled to the first mounting collar and the fingers defining the second connecting portions are integrally and seamlessly formed of unitary material together with a second collar portion which is mechanically coupled to the second mounting collar.

Preferably the tubing member is mechanically coupled at opposing first and second ends of the tubing member to a first end connector connected to the first mounting collar and a second end connector connected to the second mounting collar respectively. The first end connector comprises an inner sleeve received within a first end portion of the tubing member and an outer sleeve surrounding the first end portion of the tubing member so as to radially clamp the first end portion of the tubing member between the inner and outer sleeves of the first end connector. Similarly, the second end connector may comprise an inner sleeve received within a second end portion of the tubing member and an outer sleeve surrounding the second end portion of the tubing member so as to radially clamp the second end portion of the tubing member between the inner and outer sleeves of the second end connector. A plurality of pin connections may be used to connect the first end connector to the first mounting collar and to connect the second end connector to the second mounting collar.

The first connecting portions may be integrally and seamlessly formed of unitary material together with a first collar portion which is mechanically coupled between the first end connector and the first mounting collar. Similarly, the second connecting portions may be integrally and seamlessly formed of unitary material together with a second collar portion which is mechanically coupled between the second end connector and the second mounting collar.

Preferably the vibration damping material comprises a resilient and elastic material which is different than the resilient material of the tubing member.

The vibration damping material may be molded about the first and second connecting portions so as to at least partially surround each of the connecting portions.

Preferably the first and second connecting portions are fully embedded within and surrounded by the vibration damping material.

When the tubing assembly is arranged to be connected in series with the piping sections of a tubing string for producing hydrocarbons from a wellbore, preferably the tubing assembly is arranged to support an axial load of a downhole pump suspended in the wellbore by the tubing string.

The tubing assembly may be connected in series with the tubing string so as to be (i) in proximity to a wellhead of the wellbore, (ii) in proximity to the downhole pump, or (iii) at an intermediate location spaced from both the wellhead of the wellbore and the downhole pump.

When the tubing assembly is arranged to receive a rod string longitudinally therethrough for driving the downhole pump, preferably the tubing assembly is arranged to resist torque applied to tubing string by the rod string driving the downhole pump.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
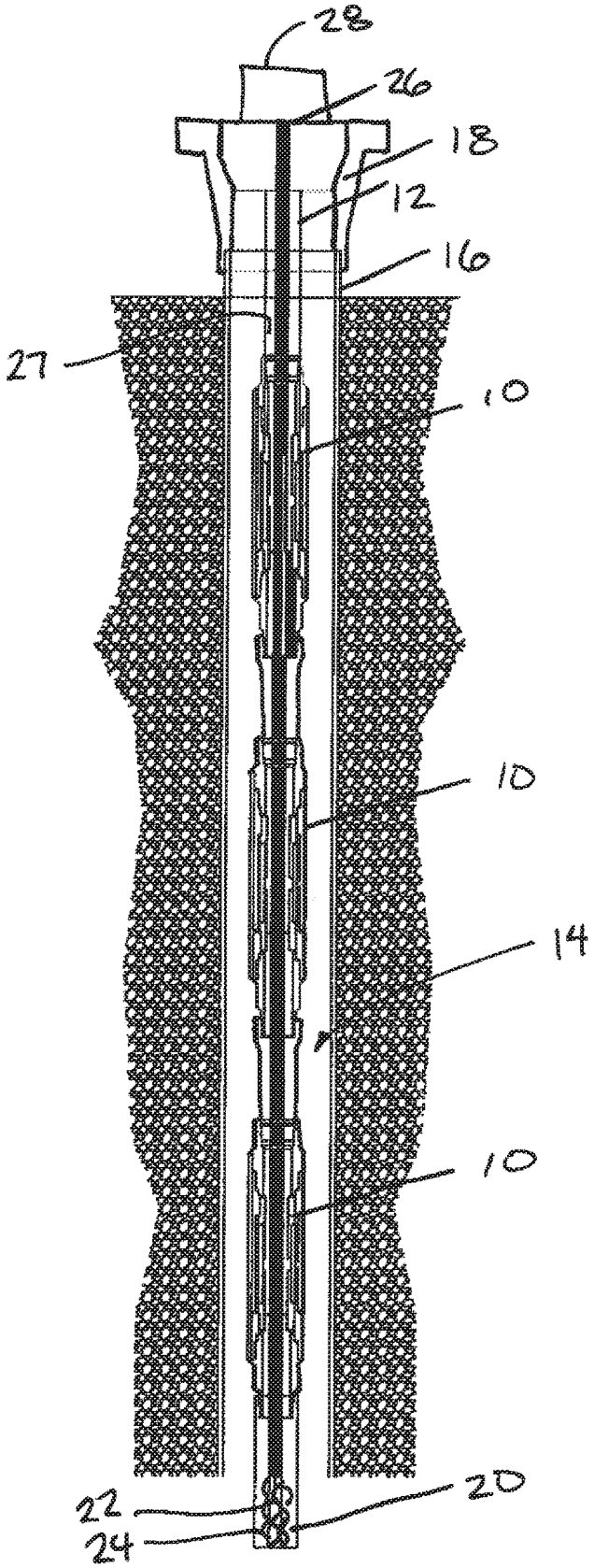
FIG. 1 is a schematic representation of the tubing assembly supported in a variety of positions relative to a tubing string within a wellbore.
Figure 2:
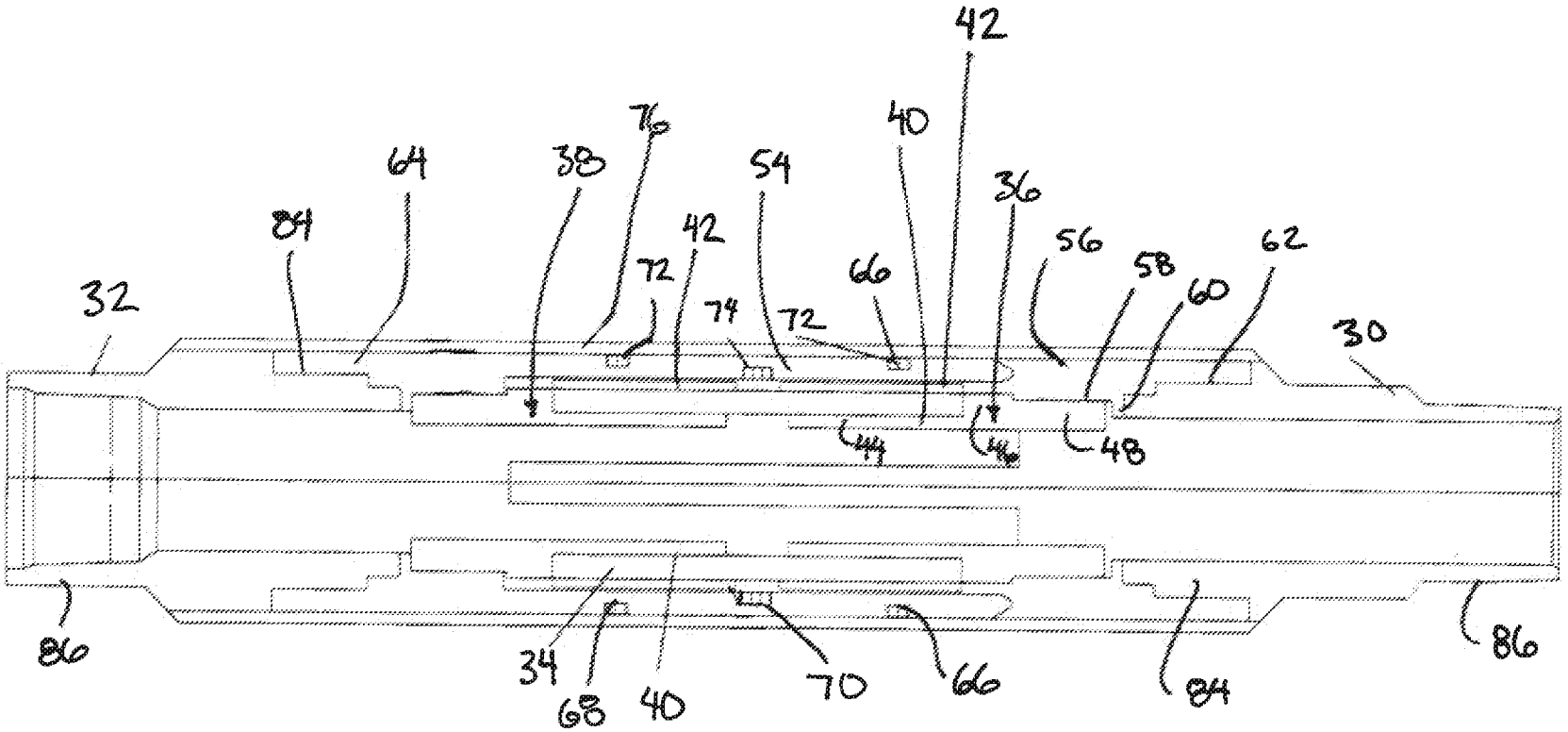
FIG. 2 is a longitudinal cross-section of the tubing assembly.
Figure 3:
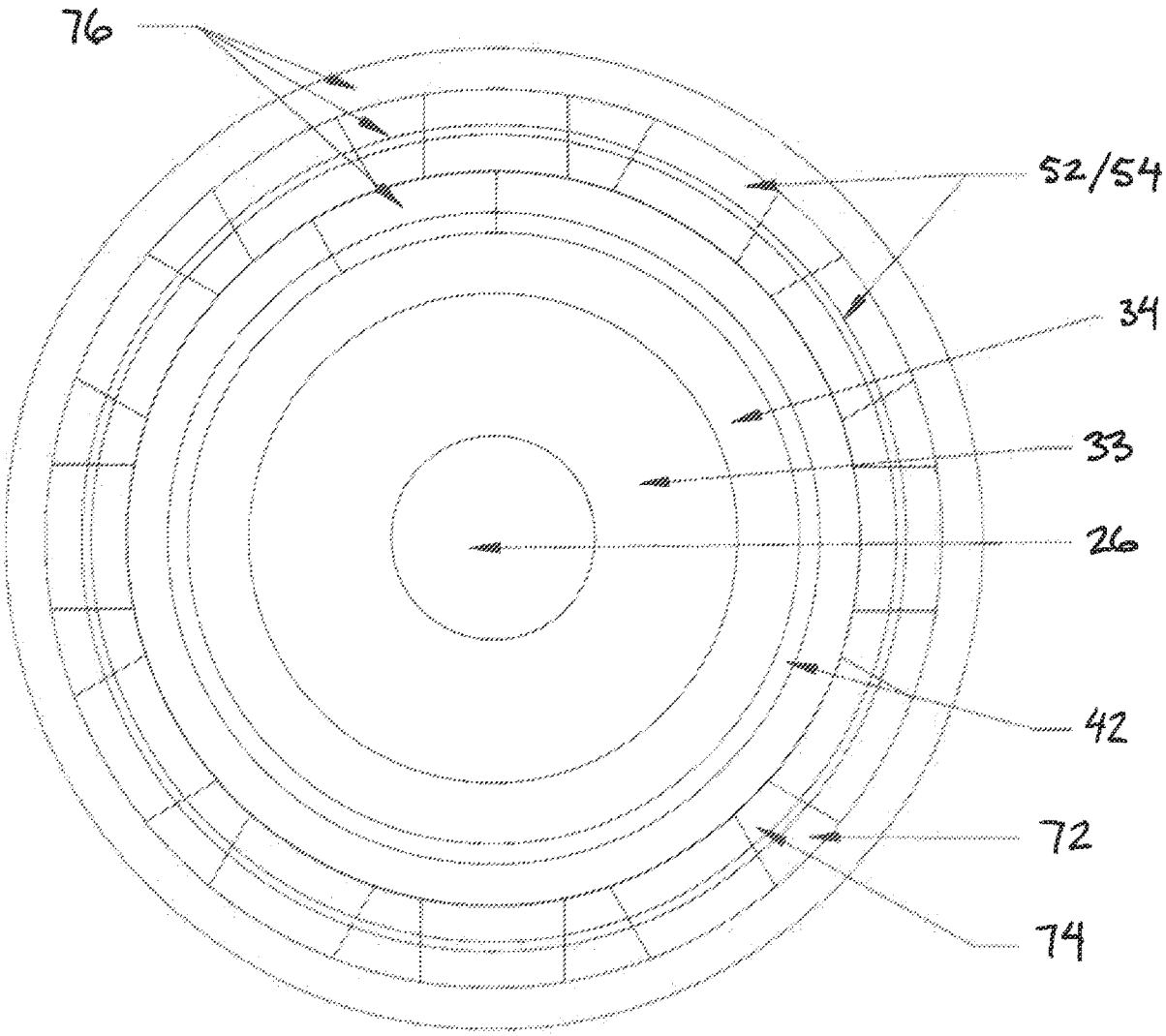
FIG. 3 is a sectional view of the tubing assembly along a plane oriented perpendicularly to the longitudinal direction.
Figure 4:
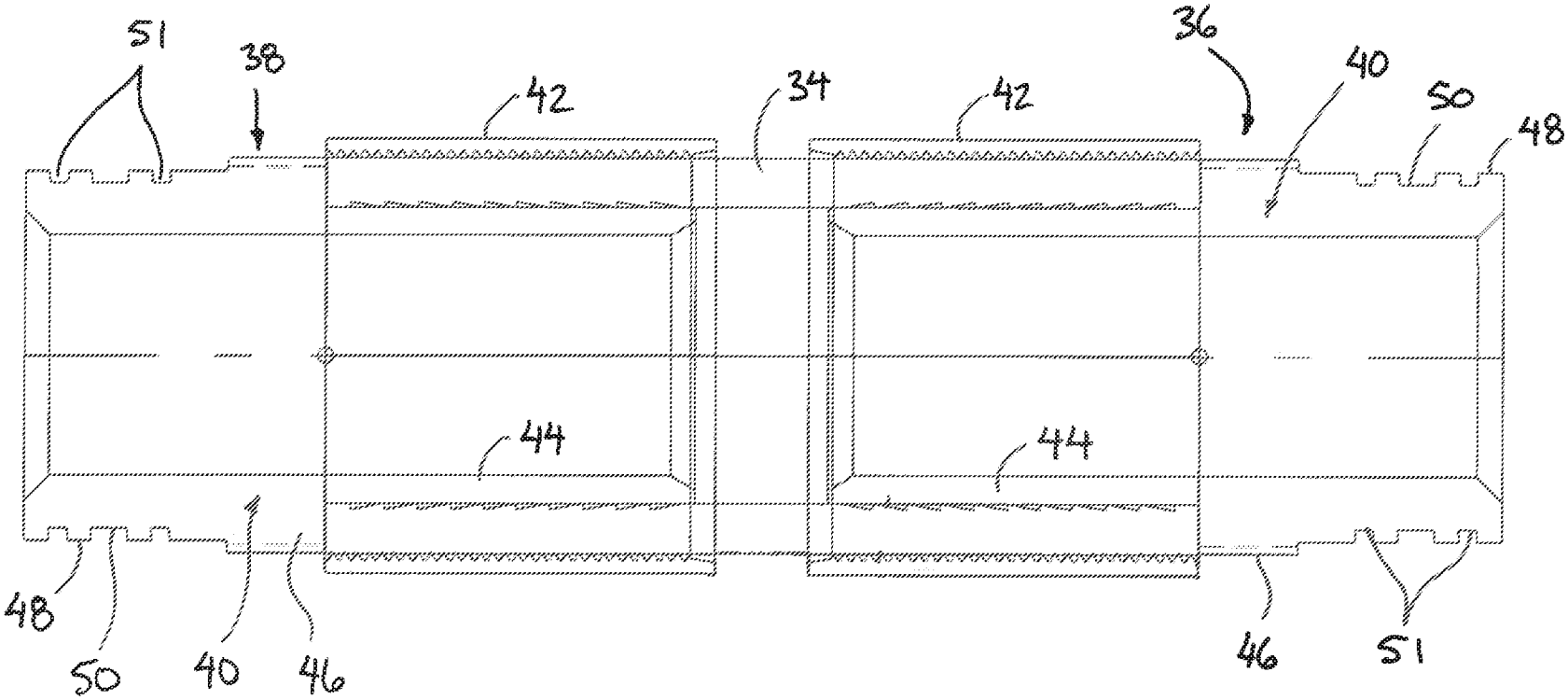
FIG. 4 is a longitudinal cross-section of the inner tubing member and first and second end connectors supported thereon shown removed from the remainder of the tubing assembly.
Figure 5:
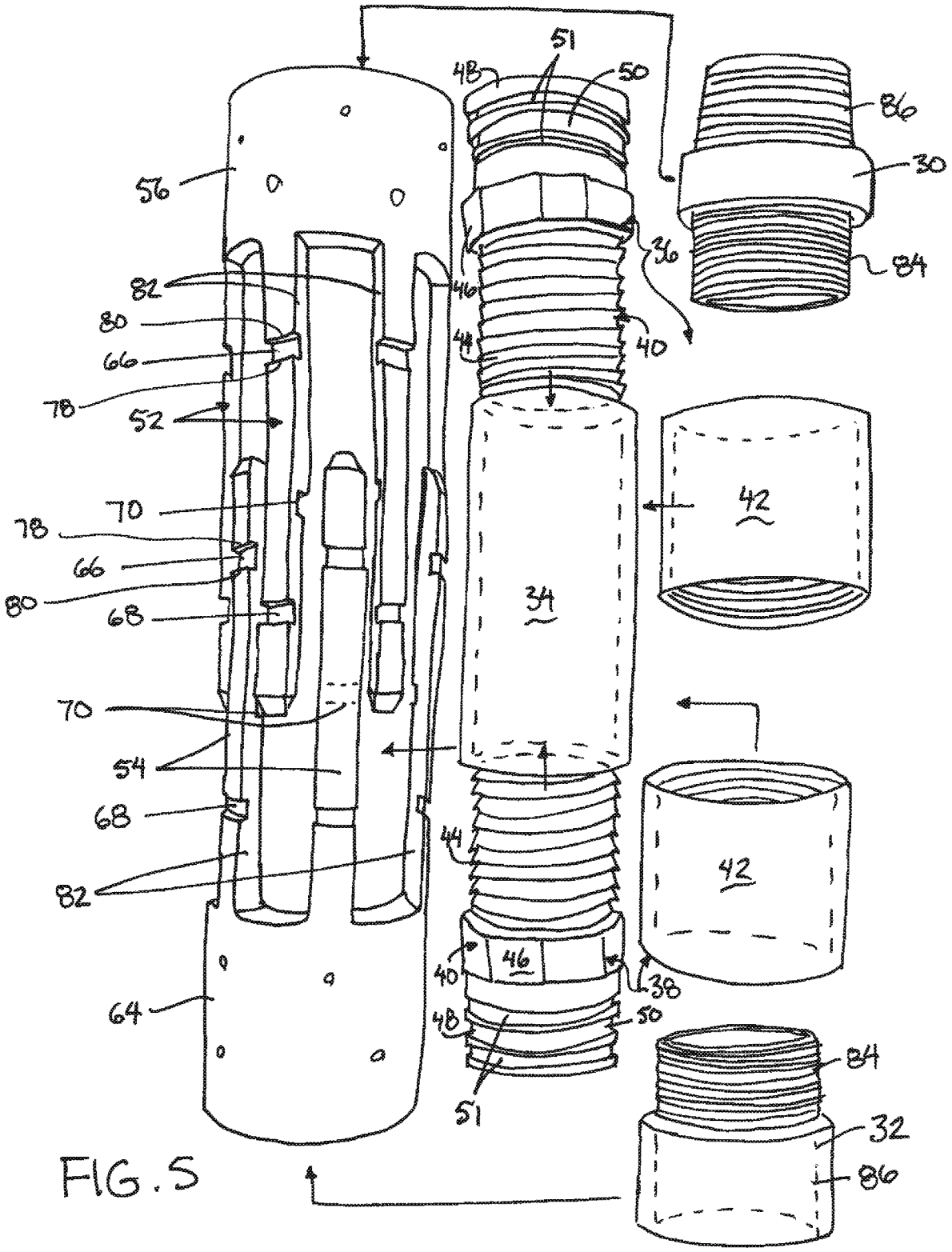
FIG. 5 is an exploded perspective view of the various inner components of the tubing assembly prior to assembly of the inner components and injection of the outer jacket of vibration damping material about the inner components.
Figure 6:
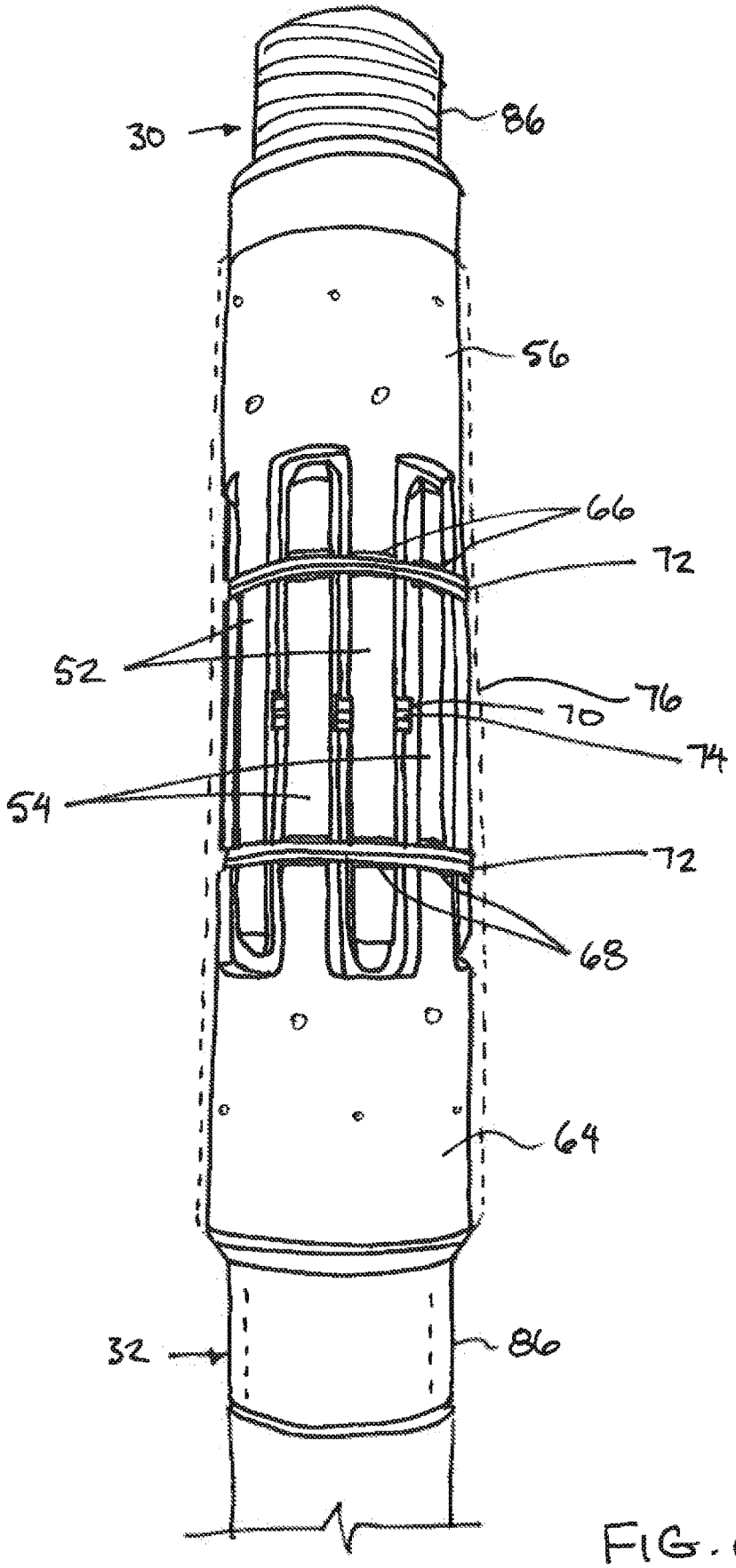
FIG. 6 is a perspective view of the various inner components of the tubing assembly subsequent to assembly of the inner components but prior to injection of the outer jacket of vibration damping material about the inner components.

Referring to the accompanying figures, there is illustrated a vibration damping tubing assembly generally indicated by reference numeral 10. The tubing assembly 10 is intended to be connected in series between two piping sections coupled at opposing ends of the tubing assembly such that fluids conveyed by the piping sections are conveyed longitudinally through the tubing assembly between the piping sections, while isolating vibrations between the piping sections such that vibrations are substantially prevented from being communicated from one piping section to the other.

In a preferred embodiment, the tubing assembly 10 is connected in series with a tubing string 12 of the type used in producing hydrocarbons from a wellbore 14. The wellbore is typically provided with an outer casing 16 lining the casing with perforations therein which communicate with a surrounding hydrocarbon formation in the ground. The tubing string is typically assembled from a plurality of pipe sections which are connected in series to extend in a longitudinal direction through the casing and the wellbore. The tubing string is typically suspended from a wellhead 18 at the surface and defines a production passage communicating therethrough from the bottom end of the tubing string to the wellhead for conveying produced hydrocarbon fluids upwardly therethrough.

In the illustrated example, a progressive cavity pump 20 is supported at the bottom end of the tubing string and includes a rotor 22 rotatably supported within a stator 24. Rotation of the rotor within the stator causes cavities between the rotor and the stator to progress upwardly for pumping fluid upwardly through the production passage in the tubing string when the rotor is rotated. A rod string 26 extends through the production passage 27 of the tubing string between a drive 28 supported at the wellhead and the pump 20 at the bottom of the tubing string. The drive 28 is used for driving rotation of the rod string and rotor 22 coupled at the bottom ends thereof relative to the stator 24 supported at the bottom end of the tubing string resulting in a torque being applied to the stator by the rotor as the rotor is rotated so as to torque the bottom end of the tubing string relative to the wellhead. The tubing string thus resist this torque applied by the pump in addition to carrying the axial load of the pump and tubing string suspended from the wellhead within the wellbore.

The tubing assembly 10 is connected in series between pipe sections of the tubing string using a first mounting collar 30 and a second mounting collar 32 supported at opposing first and second ends of the assembly respectively. The first and second mounting collars are adapted for connection to the pipe sections, typically using conventional male and female threaded connections commonly employed for joining pipe sections of a tubing string together. The tubing assembly 10 includes a fluid passage 33 communicating longitudinally therethrough between the opposing mounting collars such that the fluid passage is connected in series with the production passage of the tubing string for conveying fluid therethrough as fluid is pumped upwardly through the tubing string.

In some instances, the tubing assembly 10 can be mounted in series with the tubing string in close proximity to the wellhead at the top end of the tubing string. Alternatively, the tubing assembly 10 may be mounted in proximity to the pump at the bottom end of the tubing string. In yet further arrangements, the tubing assembly 10 may be mounted in series with the tubing string at an intermediate location spaced from both the top and bottom ends of the tubing string. All three locations are represented in FIG. 1. It may also be desirable in some instances to supported the tubing assembly at multiple locations along the tubing string at the same time.

In each instance the tubing assembly 10 provides a gap of resilient, vibration damping material connected in series between spaced apart rigid components of the tubing assembly and the pipe sections above and below the resilient gap such that the vibration damping material of the tubing assembly serves to isolate transmission of vibrations longitudinally therethrough between the pipe sections connected at opposing ends of the assembly. When connected in series with a production tubing string as described above, the tubing assembly 10 serves to limit transmission of vibrations from the pump upwardly through the tubing string while still being configured to resist any torque applied between opposing ends of the tubing assembly and to carry axial loads either under compression or tension between opposing ends of the tubing assembly as described in further detail below.

The tubing assembly 10 generally includes an inner tubing member 34 comprised of a sleeve of resilient material having a generally cylindrical inner surface and a generally cylindrical outer surface with a passage extending longitudinally therethrough so that a portion of the inner surface defines part of the boundary of the fluid passage of the overall assembly. The sleeve may be formed of a composite resilient material such as rubber with embedded fiber or strand material therein so as to remain resilient while having some strength to contain high-pressure fluids therein without rupturing the resilient rubber material.

The assembly further includes a first end connector 36 and a second end connector 38 formed of rigid material, for example metal such as stainless steel, mechanically coupled to opposing ends of the inner tubing member 34. Each of the end connectors includes an inner member 40 received inside a respective end portion of the tubing member and an outer member 42 extending about a respective end portion of the outer surface of the tubing member.

More particularly the inner member 40 includes an inner sleeve 44 having a generally cylindrical outer surface which is ribbed, textured or otherwise formed with annular catches thereon so as to mate with the inner surface of the inner tubing member 34 by interference fit to grip the inner surface relative to the end connector. The inner member further includes an integral collar 46 which is enlarged in outer diameter relative to the inner sleeve 44 forming a shoulder that abuts the end of the inner tubing member 34 in a mounted position. The outer circumference of the integral collar may be polygonal in shape to enable gripping with a suitable tool to torque the end connector if required. The inner member further includes an end portion 48 extending axially outward from the integral collar 46 which is generally cylindrical in shape, having an outer diameter which is reduced relative to the collar 46. The inner sleeve 44, the integral collar 46 and the end portion 48 of each inner member are connected in series with a continuous inner diameter throughout in which the cylindrical inner surface of the inner member forms part of the boundary of the resulting fluid passage communicating through the tubing string. The end portion 48 of the inner member further includes an annular groove 50 extending about the circumference thereof for connection to additional components of the assembly as described in further detail below. Additional annular grooves 51 receive O-rings therein for sealing against adjacent components.

The outer member 42 of each end connector 36 or 38 is an outer sleeve having a length in the axial direction which is approximately equal to the inner sleeve 44 of the inner member but has an interior diameter which closely fits with the outer diameter of the tubing member. The inner diameter of the outer sleeve is slightly undersized relative to the outer diameter of the tubing member however to apply some radial constriction or compression to the end portion of the inner tubing member 34 received therein so that the outer member 42 assists in clamping the end portion of the inner tubing member 34 against the textured outer surface of the inner sleeve 44 of the inner member 40. In this manner each end connector 36 or 38 radially clamps a respective end portion of the inner tubing member 34 therein to mechanically couple the rigid material of the first and second end connectors 36 and 38 to opposing ends of the resilient inner tubing member 34.

The inner ends of both end connectors remain mounted with an axial gap in the longitudinal direction therebetween when the corresponding integral collars 46 of the end connectors are abutted at opposing ends of the inner tubing member 34 to maintain a resilient gap between the rigid components of the first and second end connectors in the assembled configuration of the assembly 10.

The assembly 10 further includes a plurality of first connecting portions 52 and a plurality of second connecting portions 54 which are supported on the first and second end connectors 36 and 38 respectively.

More particularly, all of the first connecting portions 52 are commonly supported on a first collar portion 56 in the form of a rigid collar having an inner end portion 58 with an inner diameter that mates with and closely receives the outer diameter of the end portion 48 of the respective first end connector 36 therein. The O-rings within the grooves 51 provide a pressure containing sealing interface between the first end connector 36 and the first collar portion 56. The first collar portion 56 also includes an inner flange 60 in which the inner diameter is stepped inwardly relative to the inner end portion 58 to define a shoulder in abutment with the outer end of the first end connector 36.

Mounting apertures are provided within the inner end portion 58 of the first collar portion 56 for receiving radially oriented connecting pins mounted therein for alignment with the annular groove 50 in the end portion 48 of the first end connector 36 received therein to axially fix the first collar portion 56 relative to the first end connector 36. The first collar portion 56 further includes an outer end portion 62 in which the inner diameter is enlarged relative to the inner flange 60 to define an additional shoulder which faces axially outward for abutment with the inner end of the first mounting collar 30 received within the outer end portion of the first collar portion 56. The outer end portion may have internal threading thereon to form a threaded connection with a corresponding portion of the first mounting collar.

The second connecting portions 54 are similarly supported on a second collar portion 64 which is substantially identical to the first collar portion 56. More particularly the second collar portion 64 includes (i) an inner end portion 58 that mates with the end portion of the second end connector 38 with O-rings in grooves 51 and pins received in the annular groove 50, (ii) an inner flange 60 that abuts the end of the second end connector 38, and (iii) an outer end portion 62 which is internally threaded for connection to a corresponding portion of the second mounting collar 32 as described above with regard to the first collar portion 56.

The first connecting portions 52 comprise elongate fingers which are elongate and extend in the longitudinal direction from the inner end of the first collar portion 56 to span most of the axial distance to the other second collar portion 64; however an axial gap is maintained between the free end of each first connecting portion 52 and the second collar portion 64. The first connecting portions are circumferentially spaced apart from one another such that the gap between any two adjacent first connecting portions is greater than the overall width in the circumferential direction of each finger. The outer surface of each first connecting portion forms part of a generally cylindrical boundary of the first connecting portions collectively joined to the first collar portion 56. More particularly the outer surfaces of the first connecting portion 52 are substantially flush with the outer diameter of the first collar portion 56.

The second connecting portions 54 are substantially identical to the first connecting portions so as to comprise elongate fingers which extend in the longitudinal direction from the inner end of the second collar portion 64 to span most of the axial distance to the other first collar portion 56 while maintaining an axial gap between the free end of each second connecting portion 54 and the first collar portion 56. Each second connecting portion 54 is received within the gap in the circumferential direction between an adjacent pair of the first connecting portions 52 so as to define an alternating sequence of first and second connecting portions about the full circumference of the tubing assembly. The width in the circumferential direction of each connecting portion is consistent, as is the gap in the circumferential direction between each first connecting portion and each of the adjacent second connecting portions on either side thereof.

The outer surfaces of all of the connecting portions collectively define an outer cylindrical boundary which is substantially flush with the outer cylindrical surfaces of both first and second collar portions. The inner surfaces of the connecting portions are all generally concave in the circumferential direction so that the inner surfaces collectively define an inner cylindrical boundary having an inner diameter which closely matches the outer diameter of the outer members 42.

Each of the first connecting portions 52 and the second connecting portions 54 includes a first outer groove 66 formed therein at a location which is closer to the first collar portion 56 than the second collar portion 64. Each first outer groove 66 extends circumferentially across the full width of the finger while being recessed relative to the outer surface of the finger in the radial direction to define a groove which is open radially to the exterior. All of the first outer grooves 66 of the first connecting portion 52 and the second connecting portion 64 are aligned with one another to define a common circumferential channel extending about the full circumference of the collective first and second connecting portions.

Each of the first connecting portions 52 and the second connecting portions 54 also includes a second outer grooves 68 formed therein at a location which is closer to the second collar portion 54 than the first collar portion 56. Each second outer groove 68 extends circumferentially across the full width of the finger while being recessed relative to the outer surface of the finger in the radial direction to define a groove which is open radially to the exterior. All of the second outer grooves 68 of the first connecting portions 52 and the second connecting portions 54 are aligned with one another to define a second common circumferential channel extending about the full circumference of the collective first and second connecting portions at a location axially spaced from the first common circumferential channel.

Each of the first connecting portions 52 and the second connecting portions 54 also includes an inner groove 70 formed therein at a location which is intermediate and spaced inwardly from both the first and second outer grooves. Each inner groove 70 extends circumferentially across the full width of the finger while being recessed relative to the inner surface of the finger in the radial direction to define a groove which is open radially to the interior. All of the inner grooves 70 of the first connecting portions 52 and the second connecting portions 54 are aligned with one another to define a third common circumferential channel extending about the full circumference of the collective first and second connecting portions.

One or more outer rings 72 are provided within the first common circumferential channel defined by the first outer grooves 66 collectively. Each outer ring 72 has an inner diameter which is close to the recessed diameter of the first outer grooves 66 and an outer diameter which is close to the outer diameter of the outer cylindrical boundary defined by the outer surfaces of the first and second connecting portions.

One or more outer rings 72 are also provided within the second common circumferential channel in the same manner as they are provided within the first common circumferential channel described above. The overall thickness of the one or more rings in each instance in the axial direction and in the radial direction is slightly undersized relative to the dimensions of the channel receiving the one or more rings therein to provide some gaps between the rigid components of the assembly. The outer rings 72 are formed of rigid metal in each instance. Each of the outer rings may be a split ring for ease of mounting onto the assembly.

One or more inner rings 74 are provided within the third common circumferential channel defined by the inner grooves 70 collectively. Each inner ring 74 has an inner diameter closely matching the inner diameter of the circumferential boundary defined by the inner surfaces of the first and second connecting portions collectively. The outer diameter of the inner rings 74 is close to the recessed diameter of the inner grooves. The inner rings are similarly formed of rigid metal and may comprise a split ring for ease of mounting onto the assembly. The overall thickness of the inner rings in the axial direction and in the radial direction is also slightly undersized relative to the dimensions of the channels receiving the rings therein to provide some gaps between rigid components of the assembly.

All of the above noted components, with the exception of the inner tubing member 34, are formed of a rigid material, for example a metal such as stainless steel. Once the rigid components described above have all been mounted in relation to one another, an outer jacket 76 of vibration damping material is applied to the exterior of the assembly by injection moulding such that the resulting outer diameter of the jacket 76 is substantially continuous along the length of the assembly between the first and second mounting collars at opposing ends. The outer jacket 76 is molded to the outer surface of the inner tubing member 34 which defines an inner boundary of the outer jacket 76. More particularly, the vibration damping material of the outer jacket fills all voids between the rigid material supported externally of the inner tubing member 34.

Portions of the vibration damping material of the outer jacket and of the inner tubing member collectively fully surround and embed all of the connecting portions 52 and 54 therein as well as the inner and outer rings 74 and 72 described above such that some of the vibration damping material isolates each rigid component from adjacent rigid components of the assembly. The various rigid components, including the first connecting portion 62 and the second connecting portions 54, and the inner and outer rings supported therebetween, are all maintained in a slightly spaced relation relative to one another by a layer of the vibration damping material therebetween so that various portions of the vibration damping material are clamped under compression between opposing load bearing surfaces acting in one or both circumferential directions and/or one or both axial directions depending upon the loading configuration of the tubing assembly 10.

Each first connecting portion 52 defines a plurality of first load bearing surfaces formed thereon. The first load bearing surfaces include (i) first shoulder surfaces 78 formed at the boundaries of the inner and outer grooves which lie perpendicular to the longitudinal direction and face towards the first collar portion or first mounting collar 30, (ii) second shoulder surfaces 80 formed at the boundaries of the inner and outer grooves which lie perpendicular to the longitudinal direction and face toward the second collar portion or second mounting collar 32, and (iii) side surfaces 82 extending the full length of each first connecting portion at circumferentially opposing sides thereof in which the side surfaces are oriented generally in the longitudinal direction and face perpendicularly to a circumferential direction of the tubing assembly.

Similarly, each second connecting portion 54 defines a plurality of second load bearing surfaces formed thereon. The second load bearing surfaces include (i) first shoulder surfaces 78 formed at the boundaries of the inner and outer grooves which lie perpendicular to the longitudinal direction and faced towards the second collar portion or second mounting collar 32, (ii) second shoulder surfaces 80 formed at the boundaries of the inner and outer grooves which lie perpendicular to the longitudinal direction and face toward the first collar portion or first mounting collar 30, and (iii) side surfaces 82 extending the full length of each second connecting portion at circumferentially opposing sides thereof in which the side surfaces are oriented generally in the longitudinal direction and face perpendicularly to a circumferential direction of the tubing assembly.

In this manner, when the tubing assembly undergoes axial tension acting to pull the first and second mounting collars apart from one another, a portion of the vibration damping material against the first shoulder surfaces 78 of both connecting portions and which is between the first shoulder surfaces and opposing surfaces of the inner and outer rings received therebetween, will be under compression between the rigid load bearing surfaces which face one another to provide sufficient strength to support loads under axial tension while maintaining a gap of the vibration damping material between any rigid components.

Similarly, when the tubing assembly undergoes axial compression acting to push the first and second mounting collars towards one another, a portion of the vibration damping material against the second shoulder surfaces 80 of both connecting portions and opposing surfaces of the inner and outer rings received therebetween will be under compression between the rigid load bearing surfaces which face one another to provide sufficient strength to support loads under axial compression while maintaining a gap of the vibration damping material between any rigid components.

Furthermore, when the tubing assembly undergoes a torque applied in either direction between the first and second mounting collars, a portion of the vibration damping material against one of the side surfaces 82 of all of the first and second connecting portions will undergo some compression between one side surface of each connecting portion and the opposing side surface of an adjacent connecting portion that it faces to support loads therebetween, while maintaining a gap of the vibration damping material between any rigid components.

Each of the first and second first mounting collars 30 and 32 includes an inner end portion 84 having an inner diameter which fits within the corresponding outer end portion of the first or second collar portion 56 or 64 respectively. The inner diameters of the mounting collars closely match the inner diameters of the first and second end connectors 36 and 38 to define part of the boundary of the fluid passage extending through the assembly. Once the inner end portion 84 of the mounting collar is received within the respective collar portion 56 or 64, connection may be maintained by a threaded connection, or the use of radially oriented pins extending through the components.

Each of the first and second mounting collars 30 and 32 also includes an outer end portion 86 which serves to connect the mounting collar to the adjacent pipe section of the tubing string. In the illustrated embodiment the outer end portion 86 of the first mounting collar 30 comprises an externally threaded male connector for forming a mating connection with the female connector of an adjacent tubing section. Furthermore, in the illustrated embodiment, the outer end portion 86 of the second mounting collar 32 comprises an internally threaded female connector for forming a mating connection with the male connector of an adjacent tubing section of the tubing string.

As described herein, rigid material is understood to comprise a material that substantially maintains its shape under considerable load, for example structural metal.

Resilient material is understood herein to be much more flexible and elastic than the rigid material, for example rubber, or a composite material of elastic material with embedded fibres having greater tensile strength to increase the strength of the rubber. The vibration damping material is a suitable resilient material capable of absorbing some of the vibratory forces from the adjacent rigid components to prevent vibrations from transferring from one rigid component to another.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A tubing assembly for conveying a fluid between two piping sections while isolating harmonics and vibrations between the two piping sections, the tubing assembly comprising:

first and second mounting collars supported at opposing ends of the tubing assembly and being formed of rigid material, the first and second mounting collars being arranged for rigid mechanical coupling to the two piping sections respectively, each of the mounting collars defining respective boundary portions of a fluid passage extending longitudinally through the tubing assembly for conveying the fluid between the two piping sections;

a tubing member formed of resilient material, the tubing member being connected between the first and second mounting collars, and the tubing member having an inner surface defining a respective boundary portion of the fluid passage of the tubing assembly;

a plurality of first connecting portions formed of rigid material connected to the first mounting collar and defining a plurality of first load bearing surfaces;

a plurality of second connecting portions formed of rigid material connected to the second mounting collar and defining a plurality of second load bearing surfaces;

a vibration damping material connected between the first and second connecting portions;

the rigid material of the first connecting portions being supported in spaced relation with the rigid material of the second connecting portions by the vibration damping material;

wherein at least a portion of the vibration damping material being under compression in a circumferential direction of the tubing assembly against the first load bearing surfaces of the first connecting portions and at least a portion of the vibration damping material being under compression in a circumferential direction of the tubing assembly against the second load bearing surfaces of the second connecting portions when a torque is applied between the first and second mounting collars; and wherein at least a portion of the vibration damping material being under compression in a longitudinal direction of the tubing assembly against the first load bearing surfaces of the first connecting portions and at least a portion of the vibration damping material being under compression in a longitudinal direction of the tubing assembly against the second load bearing surfaces of the second connecting portions when a longitudinal force is applied between the first and second mounting collars.

2. The tubing assembly according to claim 1 wherein the first load bearing surfaces include some surfaces that are oriented transversely to the longitudinal direction and that face towards the first mounting collar and wherein the second load bearing surfaces include some surfaces that are oriented transversely to the longitudinal direction and that face towards the second mounting collar, and wherein said surfaces receive some of the vibration damping material under axial compression against the surfaces.

3. The tubing assembly according to claim 1 wherein the first load bearing surfaces include some surfaces that are oriented transversely to the longitudinal direction and that face towards the second mounting collar and wherein the second load bearing surfaces include some surfaces that are oriented transversely to the longitudinal direction and that face towards the first mounting collar, and wherein said surfaces receive some of the vibration damping material under axial compression against the surfaces.

4. The tubing assembly according to claim 1 further comprising at least one intermediate member formed of rigid material and which is supported by the vibration damping material at an intermediate location in the longitudinal direction between the first load bearing surfaces of the first connecting portions and the second load bearing surfaces of the second connecting portions, whereby some of the vibration damping material is in compression in the longitudinal direction between the first loading bearing surfaces and the intermediate member, and whereby some of the vibration damping material is in compression in the longitudinal direction between the intermediate member and the second loading bearing surfaces.

5. The tubing assembly according to claim 1 wherein the first connecting portions comprise elongate fingers extending in the longitudinal direction from the first mounting collar towards the second mounting collar, and wherein the second connecting portions comprise elongate fingers extending in the longitudinal direction from the second mounting collar towards the first mounting collar in overlapping relationship with the first connecting portions in the longitudinal direction.

6. The tubing assembly according to claim 5 wherein each of the first connecting portions is spaced in the circumferential direction from each of the second connecting portions.

7. The tubing assembly according to claim 5 wherein the fingers defining the first connecting portions are integrally and seamlessly formed of unitary material together with a first collar portion which is mechanically coupled to the first mounting collar and wherein the fingers defining the second connecting portions are integrally and seamlessly formed of unitary material together with a second collar portion which is mechanically coupled to the second mounting collar.

8. The tubing assembly according to claim 1 wherein the tubing member is mechanically coupled at opposing first and second ends of the tubing member to a first end connector connected to the first mounting collar and a second end connector connected to the second mounting collar respectively.

9. The tubing assembly according to claim 8 wherein the first end connector comprises an inner sleeve received within a first end portion of the tubing member and an outer sleeve surrounding the first end portion of the tubing member so as to radially clamp the first end portion of the tubing member between the inner and outer sleeves of the first end connector, and wherein the second end connector comprises an inner sleeve received within a second end portion of the tubing member and an outer sleeve surrounding the second end portion of the tubing member so as to radially clamp the second end portion of the tubing member between the inner and outer sleeves of the second end connector.

10. The tubing assembly according to claim 8 wherein a plurality of pin connections connect the first end connector to the first mounting collar and connect the second end connector to the second mounting collar.

11. The tubing assembly according to claim 8 wherein the first connecting portions are integrally and seamlessly formed of unitary material together with a first collar portion which is mechanically coupled between the first end connector and the first mounting collar and wherein the second connecting portions are integrally and seamlessly formed of unitary material together with a second collar portion which is mechanically coupled between the second end connector and the second mounting collar.

12. The tubing assembly according to claim 1 wherein the vibration damping material comprises a resilient and elastic material which is different than the resilient material of the tubing member.

13. The tubing assembly according to claim 1 wherein the vibration damping material is molded about the first and second connecting portions so as to at least partially surround each of the connecting portions.

14. The tubing assembly according to claim 1 wherein the first and second connecting portions are fully embedded within and surrounded by the vibration damping material.

15. The tubing assembly according to claim 1 wherein the tubing assembly is arranged to be connected in series with the piping sections of a tubing string for producing hydrocarbons from a wellbore and wherein the tubing assembly is arranged to support an axial load of a downhole pump suspended in the wellbore by the tubing string.

16. The tubing assembly according to claim 15 in combination with the tubing string in the wellbore, wherein the tubing assembly is connected in series with the tubing string in proximity to a wellhead of the wellbore.

17. The tubing assembly according to claim 15 in combination with the tubing string in the wellbore, wherein the tubing assembly is connected in series with the tubing string in proximity to the downhole pump.

18. The tubing assembly according to claim 15 in combination with the tubing string in the wellbore, wherein the tubing assembly is connected in series with the tubing string at an intermediate location spaced from both a wellhead of the wellbore and the downhole pump.

19. The tubing assembly according to claim 15 wherein the tubing assembly is arranged to receive a rod string longitudinally therethrough for driving the downhole pump, and wherein the tubing assembly is arranged to resist torque applied to tubing string by the rod string driving the downhole pump.

* * * * *